US008020900B2

(12) United States Patent
Li et al.

(10) Patent No.: US 8,020,900 B2
(45) Date of Patent: Sep. 20, 2011

(54) LATCHING MECHANISM

(75) Inventors: Jian-Jun Li, Shenzhen (CN); Te-Sheng Jan, Taipei Hsien (TW); Yu-Tao Chen, Taipei Hsien (TW); Chun-Che Yen, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 746 days.

(21) Appl. No.: 12/147,496

(22) Filed: Jun. 27, 2008

(65) Prior Publication Data

US 2009/0184523 A1 Jul. 23, 2009

(30) Foreign Application Priority Data

Jan. 23, 2008 (CN) ..... 2008 1 0300198

(51) Int. Cl.
*E05C 5/04* (2006.01)

(52) U.S. Cl. ..... 292/61; 292/DIG. 4; 411/51

(58) Field of Classification Search ..... 292/288, 292/60–62, DIG. 4; 411/551
See application file for complete search history.

(56) References Cited

U.S. PATENT DOCUMENTS

| | | | | |
|---|---|---|---|---|
| 6,059,326 | A * | 5/2000 | Tramontina | 292/169 |
| 7,152,892 | B2 * | 12/2006 | Rechberg | 292/304 |
| 7,520,540 | B2 * | 4/2009 | Lin et al. | 292/83 |
| 7,695,031 | B2 * | 4/2010 | Jackson et al. | 292/169 |

FOREIGN PATENT DOCUMENTS

| | | |
|---|---|---|
| TW | 559456 | 10/2003 |
| TW | M332719 | 5/2008 |

* cited by examiner

*Primary Examiner* — Gary Estremsky
(74) *Attorney, Agent, or Firm* — Altis Law Group, Inc.

(57) ABSTRACT

An exemplary latching mechanism (10) includes a detachable member (12), an elastic member (18), a positioning member (20), a rotatable member (22), and a base (24). The detachable member has a pair of clasping portions (124) and a pair of actuators (126). The elastic member is disposed between the positioning member and the detachable member for providing elastic force. The rotatable member is disposed on the base. The rotatable member includes a plurality of pedals (226) for engaging with the actuators of the detachable member and a plurality of latching portions (224) for abutting the clasping portions of the detachable member. The positioning member engages with the rotatable member. When the detachable member is pressed, the detachable member can be latched on or detached from the base.

15 Claims, 5 Drawing Sheets

LATCHING MECHANISM

BACKGROUND OF THE INVENTION

1. Field of the Invention

The present invention relates to latching mechanisms, more particularly to a latching mechanism that can be operated conveniently.

2. Discussion of the Related Art

Various types of consumer products such as toys, portable electronic devices, and most other devices with a mechanical feature generally includes two connected members. The connected members are generally designed to be latched to and/or unlatched from each other.

Conventional connected members includes a main body and a cover. An end of the main body and the cover may be pivotably connected by a pivot shaft. Another end of each of the main body and the cover may forms a hook and a catch, respectively. The hook is configured for engaging with the catch. When a force is applied on the main body and the cover to make the hook engage with or disengage from the catch, the cover is latched to or unlatched from the main body.

However, conventional connected members are hard to be latched or unlatched by users. For different structured consumer products with conventional connected members, different maneuvers are needed to correctly operate them, which leads to further inconvenience.

Therefore, a latching mechanism which is convenient to be operated is desired.

SUMMARY

An exemplary latching mechanism includes a detachable member, an elastic member, a positioning member, a rotatable member, and a base. The detachable member has a pair of clasping portions and a pair of actuators. The elastic member is disposed between the positioning member and the detachable member for providing elastic force. The rotatable member is disposed on the base. The rotatable member includes a plurality of pedals for engaging with the actuators of the detachable member and a plurality of latching portions for abutting the clasping portions of the detachable member. The positioning member engages with the rotatable member. When the detachable member is pressed, the detachable member can be latched on or detached from the base.

Other advantages and novel features will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of the present latching mechanism. Moreover, in the drawings, like reference numerals designate corresponding parts throughout the several views, and all the views are schematic.

DETAILED DESCRIPTION OF THE EMBODIMENTS

The present invention provides a latching mechanism generally employed in consumer products such as electronic devices and toys.

Figure 1:
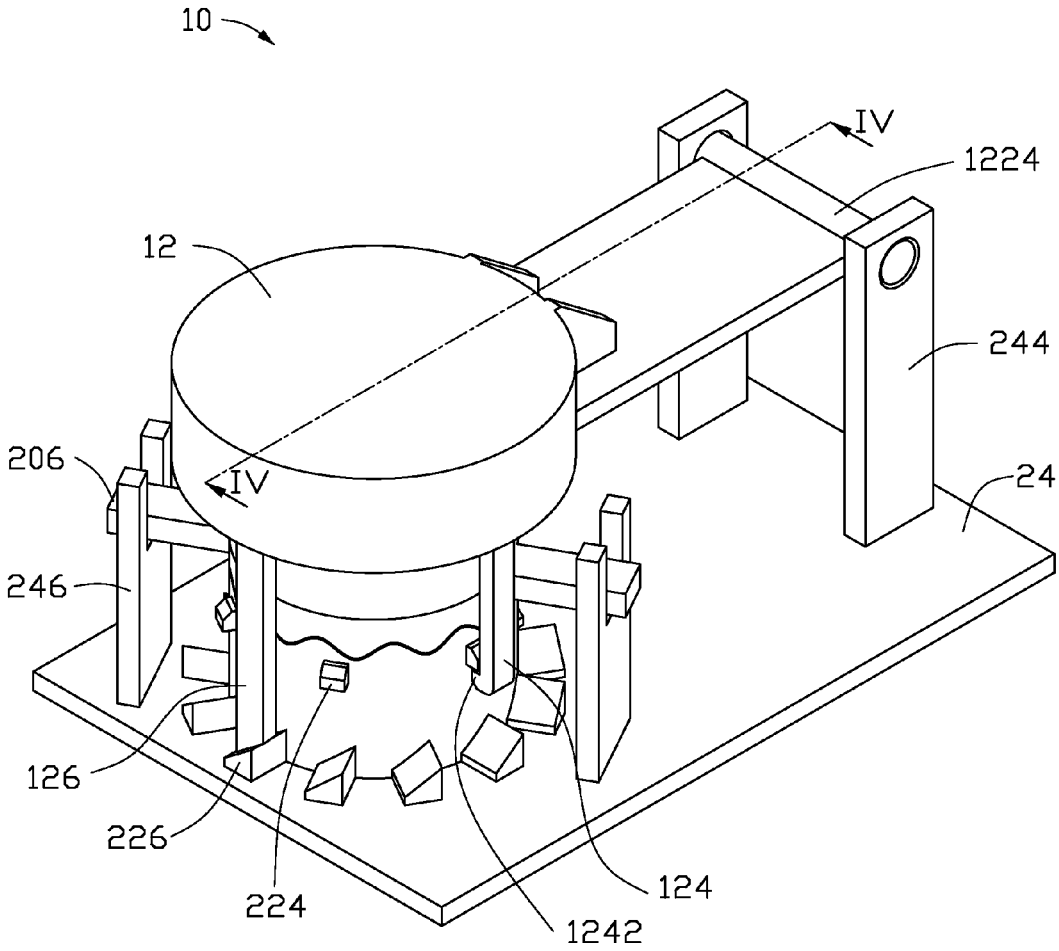
FIG. 1 is an assembled, isometric view of an exemplary embodiment of a latching mechanism of the present invention, showing the latching mechanism in a first state.
Figure 2:
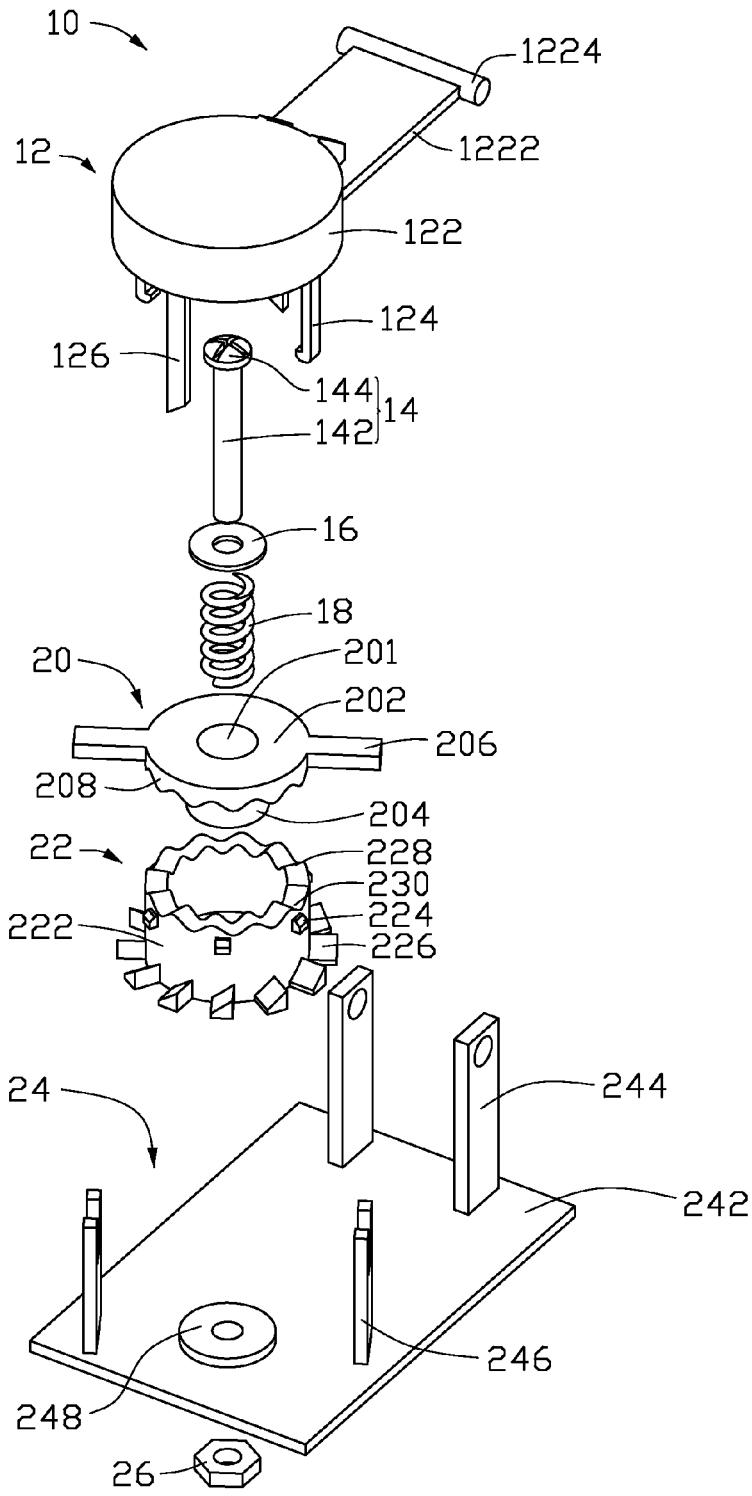
FIG. 2 is an exploded, isometric view of the latching mechanism of FIG. 1.
Figure 3:
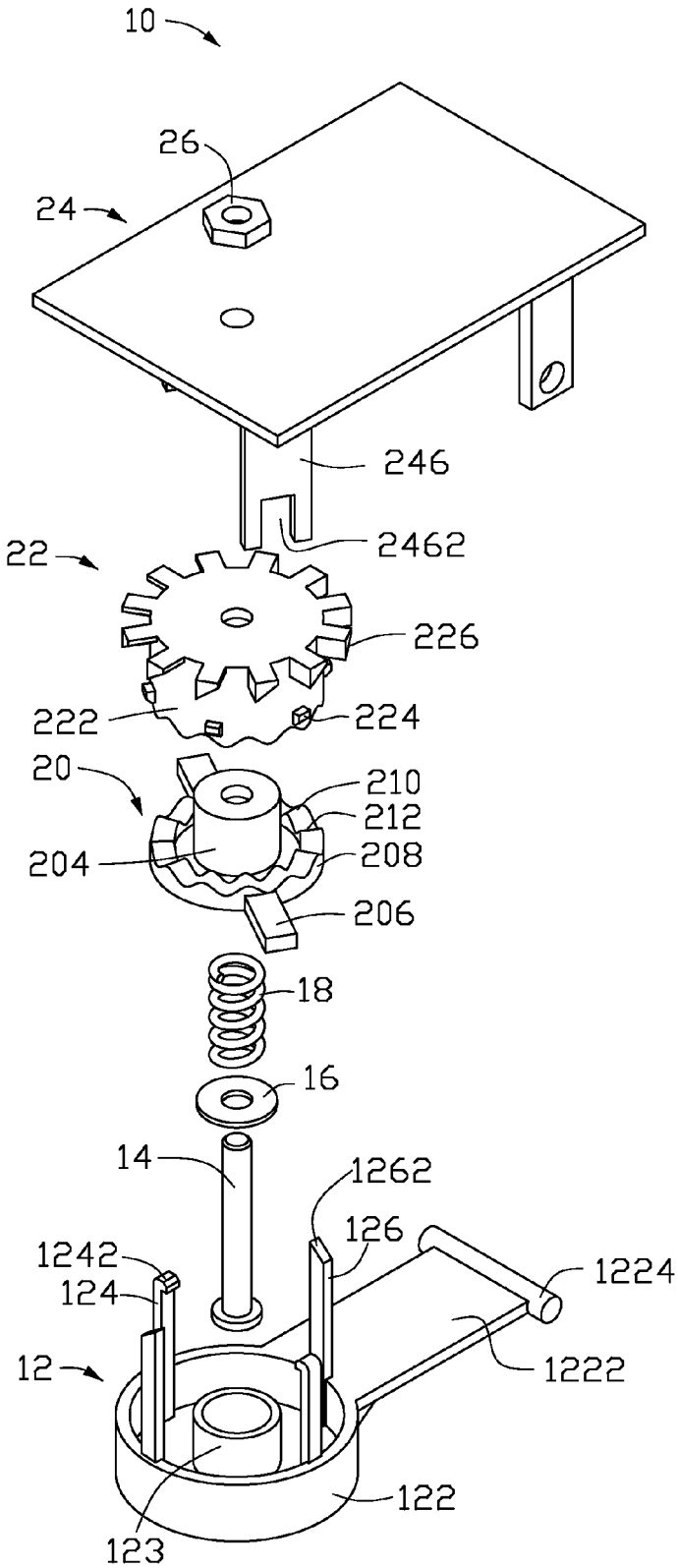
FIG. 3 is similar to FIG. 2, but viewed from an opposite aspect.

Referring to FIGS. 1 through 3, a latching mechanism 10 of an exemplary embodiment of the present invention includes a detachable member 12, a shaft 14, a washer 16, an elastic member 18, a positioning member 20, a rotatable member 22, a base 24, and a fixing member 26.

The detachable member 12 includes an actuating portion 122, a connecting portion 1222, a resisting portion 123, two clasping portions 124, and two actuators 126. Each of the actuating portion 122 and the resisting portion 123 is a cylinder in shape, and further defines a hollow space. The actuating portion 122 and the resisting portion 123 are aligned coaxially, and the diameter of the actuating portion 122 is larger than that of the resisting portion 123. The connecting portion 1222 extends perpendicularly to the cylindrical axis of the actuating portion 122 from a cylindrical side surface of the actuating portion 122, and an end of the connecting portion 1222 opposite to the actuating portion 122 forms a pivot shaft 1224. The clasping portions 124 and the actuators 126 extend perpendicularly from a bottom surface of the actuating portion 122. A clasp 1242 is formed at an end of each clasping portion 124. The clasping portions 124 are aligned mirroring each other, with the clasps 1242 of the clasping portions 124 facing each other.

The actuators 126 have a height larger than that of the clasping portions 124. The two actuators 126 are parallel to each other. Each actuator 126 includes a slanted surface 1262 formed at an end opposite to the bottom surface of the actuating portion 122. The slanted directions of the slanted surfaces 1262 are opposite to each other. Alternatively, the number of the clasping portions 124 and the actuators 126 may be only one or more than two.

The shaft 14 includes a shaft portion 142 and a shaft head 144. The shaft portion 142 and the shaft head 144 are both cylindrical, and the diameter of the shaft head 144 is larger than that of the shaft portion 142. A screw thread (not shown) is defined on the shaft portion 142.

The washer 16 is ring-shaped. The maximum diameter of the washer 16 is substantially equal to the diameter of the resisting portion 123 of the detachable member 12. The elastic member 18 is preferably a compressed, helical spring.

The positioning member 20 is substantially T-shaped. It includes a cam portion 202 and a middle portion 204 surrounded by the cam portion 202. The cam portion 202 is substantially a cylinder. Two extending pieces 206 are perpendicularly formed on a cylindrical surface of the cam portion 202. The extending pieces 206 are aligned in a same line. A rim 208 extends peripherally from the cylindrical surface of the cam portion 202. The rim 208 includes a cam surface (not labeled) having a plurality of peaks 210 and defining a plurality of troughs 212. The peaks 210 and the troughs 212 are formed in an alternating order. The cam surface substantially forms a non-ending sinusoid curve around the top surface of the rim. In this embodiment, the number of the peaks 210 and the number of the troughs 212 are both twelve, and the central angle between adjacent peaks 210 and the central angle between adjacent troughs 212 are both 30 degrees. The middle portion 204 is substantially a hollow cylinder. A diameter of the middle portion 204 is smaller than that of the cam portion 202, and the middle portion 204 and the cam portion 202 have a same central axis.

Figure 4:
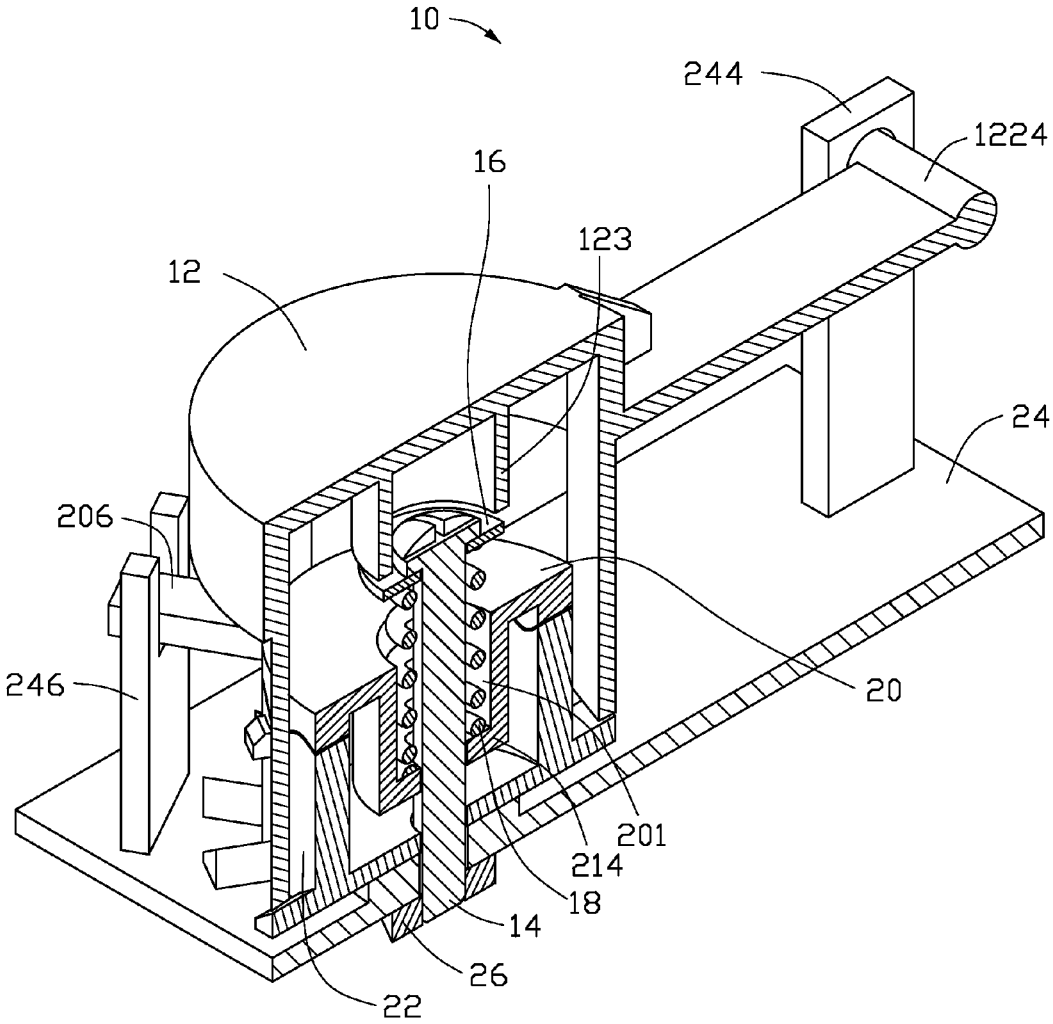
FIG. 4 is an isometric, cross-sectional view of the latching mechanism of FIG. 1, taken along line IV-IV of FIG. 1.

Referring also to FIG. 4, the positioning member 20 defines a hole 201. The hole 201 extends through the cam portion 202 and the middle portion 204. A ledge 214 is formed in the inner wall forming the hole 201 to resist the elastic member 18.

The rotatable member 22 includes a main portion 222, a plurality of latching portions 224, and a plurality of pedals 226.

The main portion 222 is substantially a hollow cylinder defining an opening (not labeled). A bottom surface of the main portion 222 defines a through hole in a center. A top surface of the main portion 222 is a cam surface having a plurality of peaks 228 and a plurality of troughs 230. The peaks 228 and the troughs 230 are formed in an alternating order. The cam surface of the rotatable member 22 substantially forms a non-ending sinusoid curve. In this embodiment, the number of the peaks 228 and the number of the troughs 230 are both twelve, and the central angle between two adjacent peaks 228 and the central angle between two adjacent troughs 230 are 30 degrees. The cam surface of the rotatable member 22 engages with the cam surface of the positioning member 20, with the peaks 228 of the rotatable member 22 engaged in the troughs 212 of the positioning member 20 and the troughs 230 of the rotatable member 22 engaged with the peaks 210 of the positioning member 20.

The latching portions 224 are evenly arranged along a cylindrical surface towards the cam surface of the main portion 222. In this embodiment, the number of the latching portions 224 is six, and the central angle between two adjacent latching portions 224 is 60 degrees. A distance between opposite latching portions 224 is slightly larger than that between the clasps 1242 of the clasping portions 124, such that the clasps 1242 can engage with the latching portions 224 when the clasps 1242 and the latching portions 224 are pushed against each other.

The pedals 226 are evenly arranged along a cylindrical surface adjacent the other end of the main portion 222 opposite the cam surface. In the illustrated embodiment, the number of the pedals 226 is twelve, and the central angle between two adjacent pedals 226 is 30 degrees. Top surfaces (not labeled) of the pedals 226 are slanted surfaces corresponding to the slanted surfaces 1262 of the actuators 126.

In an alternative embodiment, the cam surfaces of the positioning member 20 and the rotatable member 22 may extend along other curves such as an undulating curve.

The base 24 includes a main sheet 242, two pivot brackets 244, two supporting brackets 246, and a platform 248. The main sheet 242 is substantially a flat sheet. The pivot brackets 244, the supporting brackets 246, and the platform 248 perpendicularly extend from a top surface the main sheet 242. The pivot brackets 244 have a height larger than that of the supporting brackets 246. The pivot brackets 244 and the platform 248 are adjacent to opposite ends of the main sheet 242 respectively. In other words, the pivot brackets 244 are on an end of the base 24, and the platform 248 is on the other end of the base 24 opposite to the pivot brackets 244. The pivot brackets 244 are parallel to each other, and a distance between the pivot brackets 244 approximately equals to a length of the pivot shaft 1224 of the detachable member 12. Each end of the pivot brackets 244 opposite to the main sheet 242 defines a through hole configured for receiving the pivot shaft 1224 of the detachable member 12.

The supporting brackets 246 are disposed symmetrically to each other relative to the platform 248. Each bracket 246 defines a cutout 2462 for engaging with the extending pieces 206 of the positioning member 20. A maximum distance between the supporting brackets 246 is smaller than a maximum distance between the extending pieces 206 of the positioning member 20. The platform 248 is cylindrical and defines a through hole in a center. The through hole extends through the platform 248 and the main sheet 242.

The fixing member 26 is a nut configured for engaging with the screw thread of the shaft 14.

In assembling, referring again to FIG. 1, the rotatable member 22 is placed on the platform 248 in such a way that they are aligned coaxially and the supporting brackets 246 are on opposite sides of the rotatable member 22. Next, the positioning member 20 is placed on the rotatable member 22, with the cam surface of the positioning member 20 engaged with the cam surface of the rotatable member 22. The positioning member 20 is supported by the supporting brackets 246 with the extending pieces 206 of the positioning member 20 engaged in the cutouts 2462 of the supporting brackets 246, so that the positioning member 20 is non-rotatable relative to the base 24.

The shaft portion 142 of the shaft 14 runs through the washer 16, the elastic member 18, the hole 201 of the positioning member 20, the through hole of the rotatable member 22, and the through hole of the platform 248 and the main sheet 242 in that order, and then the fixing member 26 engages with the end of the shaft 14 opposite to the shaft head 144. The fixing member 26 is tightened such that the elastic member 18 is slightly compressed between the washer 16 and the ledge 214 of the positioning member 20. The washer 16 is disposed between the resisting portion 123 of the detachable member 12 and the positioning member 20. When the washer 16 is pressed under the resisting portion 123, the washer 16 moves downwards and applies a force on the elastic member 18. Two ends of the pivot shaft 1224 of the detachable member 12 are inserted into the through holes of the pivot brackets 244, thus allowing the detachable member 12 to rotate relatively to the base 24.

When the rotatable member 22 is in a first state, as shown in FIG. 1, the actuators 126 of the detachable member 12 rest on opposite sides of the pedals 226 of the rotatable member 22 correspondingly, with the slanted surfaces of the actuators 126 engaged with the slanted surfaces of the pedals 226. The clasps 1242 of the clasping portions 124 abut two opposite sides of the latching portions 224 correspondingly. In other words, the detachable member 12 is latched to the base 24.

Figure 5:
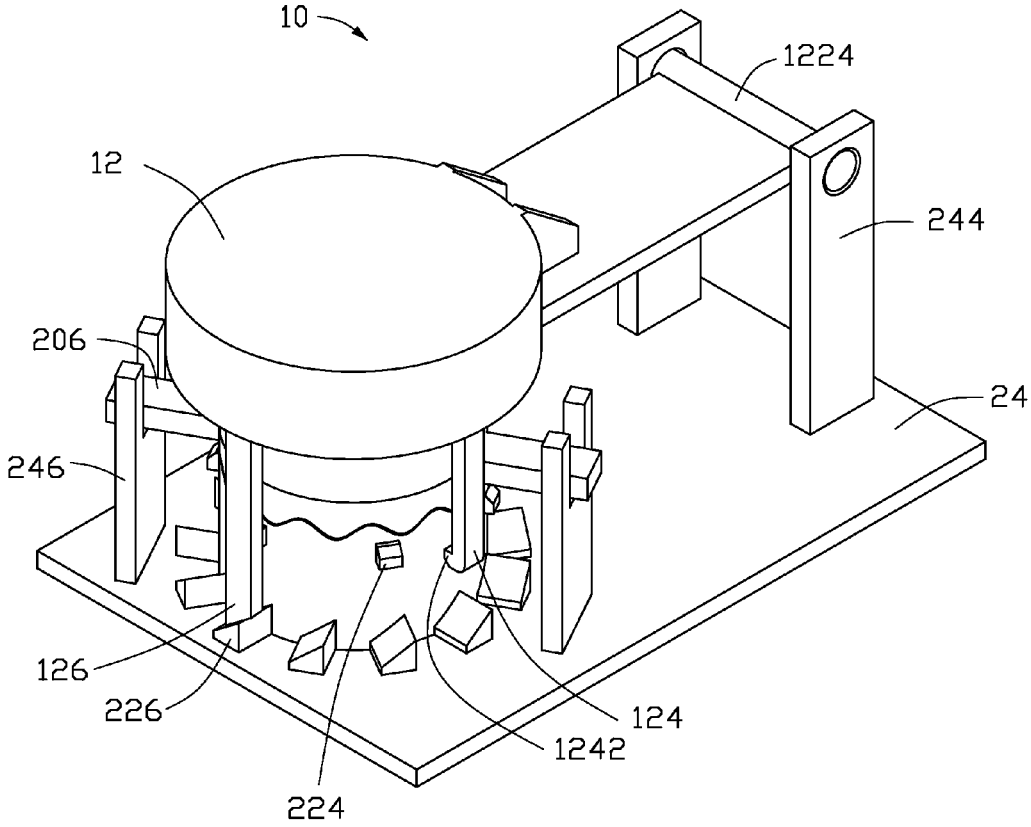
FIG. 5 is an assembled, isometric view of the latching mechanism of FIG. 1, showing the latching mechanism in a second state.

Referring to FIG. 5, when the rotatable member 22 is in a second state, the actuators 126 of the detachable member 12 rest on another pair of opposite sides of the pedals 226 of the rotatable member 22 correspondingly, with the slanted surfaces of the actuators 126 engaged with the slanted surfaces of the pedals 226. The clasps 1242 of the clasping portions 124 are unlatched from the latching portions 224. In other words, the detachable member 12 is detached from the base 24.

To detach (open) the detachable member 12 relative to the base 24, the detachable member 12 is pushed towards the main sheet 242 of the base 24. The actuators 126 of the detachable member 12 push a corresponding pair of pedals 226 of the rotatable member 22 downwards. The actuators 126 slide along the slanted surfaces of the pedals 226. The detachable member 12, together with the resisting portion 123 moves downwards. The resisting portion 123 pushes the washer 16 downwards, thereby compressing the elastic member 18. An external force along a slanted direction of the corresponding slanted surfaces of the pedals 226 is applied on the pedals 226 of the rotatable member 22. The external force creates a turning moment on the rotatable member 22 so as to enable the rotatable member 22 to rotate about an axis of the rotatable member 22. Thus, the rotatable member 22 rotates relative to the positioning member 20, and the peaks 228 of the rotatable member 22 slide out of the troughs 212 of the positioning member 20. At the same time, the positioning member 20 moves upwards relative to the rotatable member 22, further compressing the elastic member 18 between the ledge 214 of the positioning member 20 and the washer 16.

When the peaks 228 of the rotatable member 22 resist the peaks 210 of the positioning member 20, the rotatable member 22 rotates a central angle of 15 degrees. Then, the peaks 228 of the rotatable member 22 begin to slide into the troughs 212 of the positioning member 20. At the same time, the elastic member 18 decompresses and pushes the cam surface of the positioning member 20 to slide relative to the cam surface of the rotatable member 22, until the peaks 228 of the rotatable member 22 are held in the troughs 212 of the positioning member 20 again. At such time, the clasps 1242 of the detachable member 12 are unlatched from the latching portions 224 of the rotatable member 22. The rotatable member 22 rotates an angle of 30 degrees and rotates from the first state to the second state.

To latch (close) the detachable member 12 to the base 24, the detachable member 12 is pushed again towards the main sheet 242 of the base 24. The actuators 126 of the detachable member 12 push a corresponding pair of pedals 226 downwards. The rotatable member 22 further rotates 30 degrees. The clasping portions 124 of the detachable member 12 abut the latching portions 224 of the rotatable member 22. At such time, the rotatable member 22 rotates from the second state to the first state.

In this embodiment, the pivot shaft 1224 of the detachable member 12 can rotate in the through hole of the pivot brackets 244 so as to restrict a movement of the detachable member 12.

Alternatively, the central angle between two adjacent peaks and between two adjacent troughs of the positioning member 20 and the rotatable member 22 may be any other degrees beside 30 degrees. The central angle between adjacent pedals 226 and the central angle between adjacent latching portions 224 may be adjusted correspondingly.

In alternative embodiments, the washer 16 may be omitted. The fixing member 26 may also be a ring and the shaft 14 defines a ring-shaped groove for engaging with the ring. The fixing member 26 may also be omitted and the shaft 14 may be riveted after assembling. The elastic member 18 may also be other elastic members such as rubber sticks or sponges. The shaft 14 may be omitted. In this case, the elastic member 18 is lengthened. The latching mechanism 10 may include a single clasping portion 124 and a single actuator 126 on the detachable member 12.

In using the latching mechanism 10, with a same action on the detachable member 12 of pressing the detachable member 12, the detachable member 12 may be latched on or detached from the base 24. In the process of latching or detaching the detachable member 12, a user can operate on the latching mechanism 10 without changing the action of his/her hand. Therefore, the latching mechanism 10 is very convenient to operate. Especially when repeatedly latching and detaching the detachable member 12, this convenience is remarkable.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A latching mechanism, comprising:

a base;

a detachable member having an end connected to the base, the detachable member including at least one actuator and at least one clasping portion;

a rotatable member disposed on the base, the rotatable member including a plurality of pedals for engaging with the at least one actuator of the detachable member and a plurality of latching portions for abutting the at least one clasping portion of the detachable member;

a positioning member engaging with the rotatable member and being non-rotatable relative to the base; and an elastic member disposed between the positioning member and the detachable member for providing elastic force to force the detachable member move away from the positioning member; and wherein the detachable member enables the rotatable member to rotate, when the at least one clasping portion of the detachable member abuts the latching portions of the rotatable member, the detachable member is latched to the base, when the at least one clasping of the detachable member disengages with the latching portions of the rotatable member, the detachable member is detached from the base.

2. The latching mechanism as claimed in claim 1, wherein the positioning member engages with the rotatable member via cam surfaces having a plurality of peaks and troughs.

3. The latching mechanism as claimed in claim 2, wherein a central angle between two adjacent peaks and between two adjacent troughs of the rotatable member and the positioning member is 30 degrees, the number of the pedals of the rotatable member is twelve, the number of the latching portions of the rotatable member is six, the pedals are formed on a cylindrical surface adjacent another end of the rotatable member opposite the cam surface, a central angle between two adjacent pedals is 30 degrees, the latching portions are formed on the cylindrical surface towards the cam surface of the rotatable member, and a central angle between two adjacent latching portions 60.

4. The latching mechanism as claimed in claim 1, wherein the detachable member includes an actuating portion, the at least one actuator perpendicularly extends from the actuating portion, and an end of the at least one actuator forms a slanted surface.

5. The latching mechanism as claimed in claim 4, wherein the rotatable member includes a cylindrical main portion, the pedals are evenly arranged along a cylindrical surface of the main portion, a surface of the pedals towards the detachable member is a slanted surface corresponding to the slanted surface of the at least one actuator, when the detachable member is pressed, the at least one actuator pushes a corresponding pedal so as to enable the rotatable member to rotate about an axis of the rotatable member.

6. The latching mechanism as claimed in claim 1, wherein the elastic member is a compressed, helical spring.

7. The latching mechanism as claimed in claim 1, further comprising a shaft, the shaft running through the elastic member, the positioning member, the rotatable member and the base.

8. The latching mechanism as claimed in claim 7, wherein the latching mechanism further comprises a washer and a fixing member, the shaft includes a shaft head and a shaft portion, the washer is sleeved on the shaft portion of the shaft and is disposed between the elastic member and the shaft head, and two ends of the elastic member resist the positioning member and the washer correspondingly.

9. The latching mechanism as claimed in claim 1, wherein the base includes a main sheet and two pivot brackets perpendicularly extends from the main sheet of the base, and each end of the pivot brackets defines a through hole, the detachable member includes a pivot shaft, two ends of the pivot shaft are inserted into the through holes of the pivot brackets, thus allowing a rotation between the detachable member and the base.

10. The latching mechanism as claimed in claim 9, wherein the base includes a main sheet and two supporting brackets perpendicularly extend from the main sheet of the base, each supporting bracket defines a cutout, the positioning member further includes two extending pieces, the extending pieces engage in the cutouts of the supporting brackets, so that the positioning member is non-rotatable relative to the base.

11. A latching mechanism, comprising:

a base having a pivot bracket;

a detachable member having an actuating portion, a pair of actuators and a pair of clasping portions formed at an end surface of the actuating portion, and a connecting portion extending from a side surface of the actuating portion, the connecting portion pivotally connected to the pivot bracket;

a rotatable member disposed on the base, the rotatable member including a plurality of pedals for engaging with the actuators of the detachable member and a plurality of latching portions for abutting the clasping portions of the detachable member; and a positioning member engaged with the rotatable member and being non-rotatable relative to the base; and wherein when the detachable member is pressed, the rotatable member rotates and the detachable member is latched on, or detached from, the base.

12. The latching mechanism as claimed in claim 11, wherein the positioning member engages with the rotatable member via cam surfaces having a plurality of peaks and troughs.

13. The latching mechanism as claimed in claim 12, wherein a central angle between two adjacent peaks and between two adjacent troughs of the rotatable member and the positioning member is 30 degrees, the number of the pedals of the rotatable member is twelve, the number of the latching portions of the rotatable member is six, the pedals are formed on a cylindrical surface adjacent another end of the main portion opposite the cam surface, a central angle between two adjacent pedals is 30 degrees, the latching portions are formed on the cylindrical surface towards the cam surface of the rotatable member, and a central angle between adjacent latching portions 60.

14. The latching mechanism as claimed in claim 11, wherein each of the actuators forms a slanted surface at an end.

15. The latching mechanism as claimed in claim 14, wherein the rotatable member includes a cylindrical main portion, the pedals are evenly arranged along a cylindrical surface of the main portion, surfaces of the pedals towards the detachable member are slanted surfaces corresponding to the slanted surfaces of the actuators, when the detachable member is pressed, the actuators push corresponding pedals so as to enable the rotatable member to rotate about an axis of the rotatable member.

* * * * *